US005651490A

United States Patent [19]

Hack

[11] Patent Number: 5,651,490

[45] Date of Patent: Jul. 29, 1997

[54] VINYL STAPLER

[76] Inventor: Charles Hack, 3 S. Division St., Rome, Ga. 30165

[21] Appl. No.: 673,020

[22] Filed: Jul. 1, 1996

Related U.S. Application Data

[63] Continuation of Ser. No. 499,601, Jul. 11, 1995, abandoned.

[51] Int. Cl.[6] ..... B25C 5/11

[52] U.S. Cl. ..... 227/147

[58] Field of Search ..... 227/110, 147, 227/156, 134

[56] References Cited

U.S. PATENT DOCUMENTS

| | | | |
|---|---|---|---|
| 47,935 | 5/1865 | Davis | 227/147 X |
| 65,360 | 6/1867 | Falardo | 227/147 X |
| 529,237 | 11/1894 | Bischoff | 227/147 X |
| 1,166,190 | 12/1915 | Dawson | 227/147 |
| 2,445,180 | 7/1948 | Maynard | 227/134 |
| 2,463,579 | 3/1949 | Vail | 227/147 X |
| 2,486,500 | 11/1949 | Shocket | 227/134 |
| 2,501,703 | 3/1950 | Wember | 227/134 X |
| 2,664,565 | 1/1954 | Percoco | 227/147 X |
| 2,845,103 | 7/1958 | Sypher | 227/147 |
| 2,968,810 | 1/1961 | Young et al. | 173/30 |
| 3,044,072 | 7/1962 | Haynes | 227/147 |
| 3,116,487 | 1/1964 | Schick | 227/147 |
| 3,166,757 | 1/1965 | Downs, Jr. | 227/156 X |
| 3,347,439 | 10/1967 | Doherty | 227/109 |
| 4,204,625 | 5/1980 | Glenn | 227/147 X |
| 5,375,755 | 12/1994 | Norvell, Jr. | 227/110 |

FOREIGN PATENT DOCUMENTS

| | | |
|---|---|---|
| 209858 | 6/1960 | Austria . |
| 54-99276 | 8/1979 | Japan . |

*Primary Examiner*—Scott A.. Smith
*Assistant Examiner*—Jay A. Stelacone
*Attorney, Agent, or Firm*—Rodgers & Rodgers

[57] ABSTRACT

This invention concerns a stapler for conventional vinyl floor covering and which includes a guide including a base plate having spaced upstanding side panels which receive therebetween a high friction gripping surface having parallel lines. According to one aspect of the invention, a high impact receiving element is secured atop the elongated tubular element and is disposed approximately midway of such element.

4 Claims, 1 Drawing Sheet

VINYL STAPLER

This application is a continuation of application Ser. No. 08/499,601, filed Jul. 11, 1995, now abandoned.

TECHNICAL FIELD

This invention concerns the field wherein a conventional stapler of heavy duty construction used in the installation of vinyl flooring is modified by structure which facilitates the application of substantial driving force to the application of staples due in large part to percussion structure formed according to one aspect of this invention.

BACKGROUND ART

U.S. Pat. No. 5,375,755 issued Dec. 27, 1994, in which an element which is angularly disposed to the main body of the stapler, is employed to serve as means for facilitating a stapling operation.

SUMMARY OF THE INVENTION

According to this invention in one form, a stapler mechanism is modified by the application of heavy duty percussion elements which are especially designed to transmit a percussion force along the structure of a stapler and thereby to facilitate the application of stapling force at various locations in order to accommodate the convenience of the user.

BEST MODE FOR CARRYING OUT THE INVENTION

Figure 1:
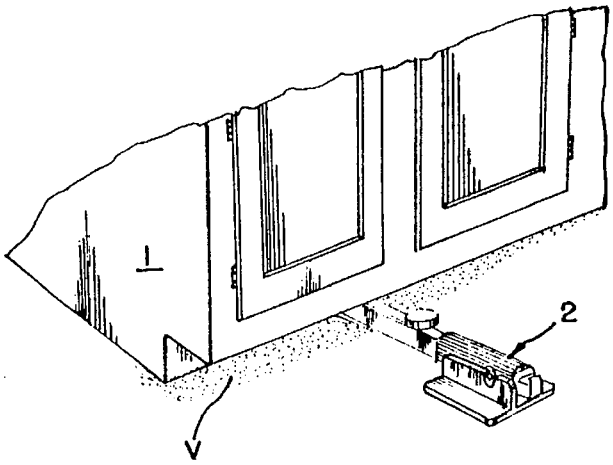
FIG. 1 is a fragmenentary view of one form of this invention in which the stapling end of the device is located underneath the toe space of a conventional item of furniture.

As best shown in FIG. 1, a piece of furniture such as a kitchen cabinet is shown in conjunction with one form of the invention in which the stapling operation is disposed in the toe space and in which the structure according to this invention is equipped with percussion items which greatly facilitate the stapling operation in toe spaces which are difficult to reach by conventional stapling means. In FIG. 1 the kitchen cabinet is identified by the numeral 1 and the stapling mechanism is generally identified by the numeral 2 with vinyl V provided as floor covering.

Figure 2:
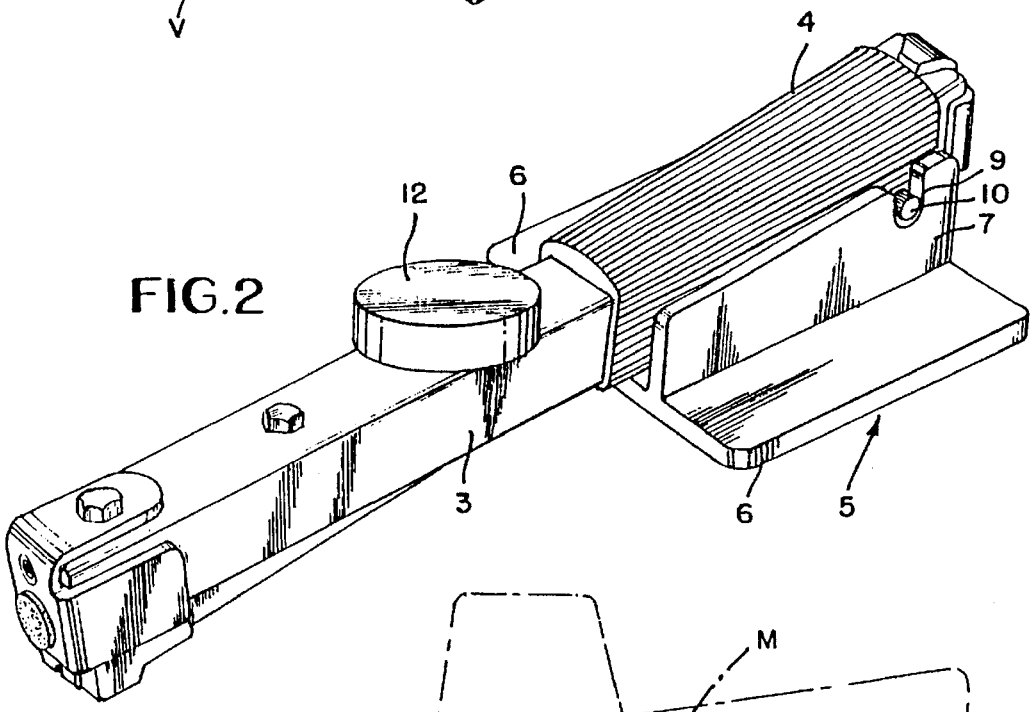
FIG. 2 is an enlarged overall view of the invention in one form.

In FIG. 2, the mechanism, shown in miniature in FIG. 1, is shown in an enlarged condition. For example, at the staple infeed end of the device, an elongated tubular element 3 is provided with manual manipulation element 4 together with guide means 5 which includes base plate 6 having spaced apart side panels 7 which are integrally formed with the base plate 6 and disposed on opposite sides of manipulation element 4. A notch 9 is formed in side panel 7 and a conventional adjustment screw 10 is disposed within notch 9, as shown in FIG. 2. The structure of notch 9 being arranged to receive screw 10 allows relative movement between side panel 7 and screw 10 is provided and is also disposed on the side of tubular element 3 which is not observable in FIG. 2. In use, base plate 6, allows the stapler to easily slide along vinyl V without tipping over.

Figure 3:
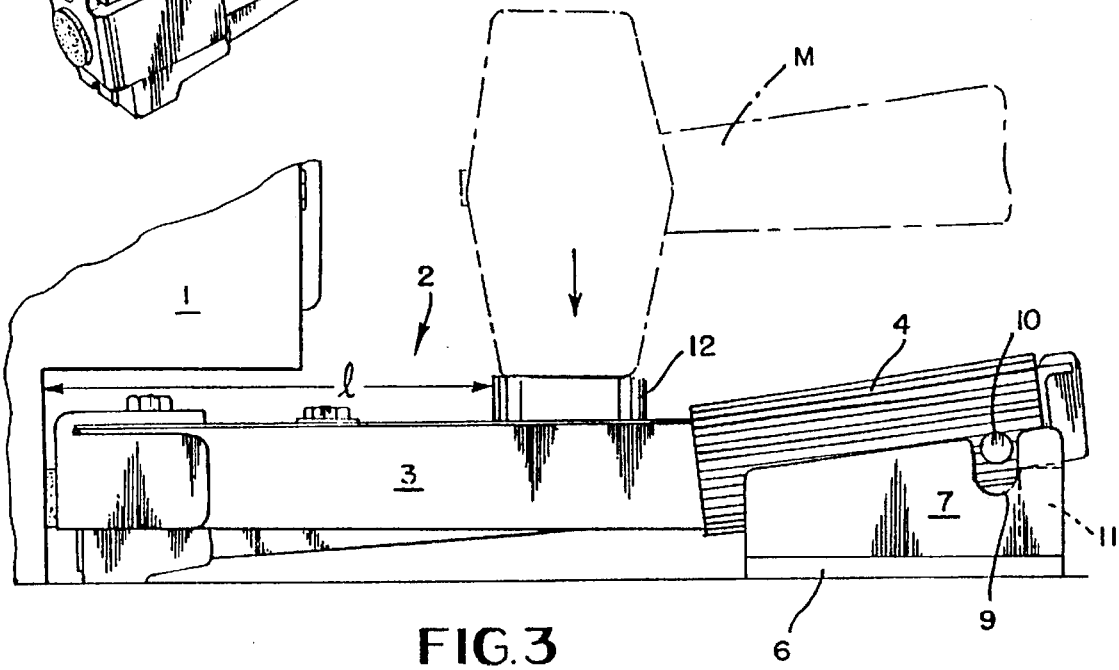
FIG. 3 is an enlarged side view of a stapler embodying the invention and which is actuated by a percussion element such for example as a heavy duty manually operated mallet.

Also, resting block 11 is generally welded in place between side panels 7 such that elongated tubular element 3 assumes an abutting relationship therewith, as shown in FIG. 3. Since tubular element 3 is angularly configured, resting block 11 allows the left hand portion of tubular element 3, as viewed in FIG. 3, to assume a horizontal disposition so that during operation of the stapler the staples are discharged in an exact vertical manner.

Percussion structure formed according to this invention not only includes base plate 6, side panels 7, and resting block 11 but also includes heavy duty percussion disc 12 securely affixed atop elongated tubular element 3.

It has been determined that the optimum distance 1 from the left hand end of tubular element 3 and as indicated by the letter "l", as viewed in FIG. 3, to disc 12 is 4½ inches so as to allow the stapler outfeed end to extend completely under the furniture toe space.

in order to effect substantial force for applying a staple into the vinyl or other material for which it is to be used, a heavy duty percussion element, such as mallet M, is provided so that the striking of disc 12 by mallet M imparts substantial force to the elongated tubular element 3 so as to apply a staple at the outfeed end of the device to vinyl V disposed under the toe space, as shown in FIG. 1.

I claim:

1. A stapler for feeding staples to a point of use and comprising an elongated tubular element having an infeed end for receiving staples and an outfeed end through which staples are fed to a point of use, guide means including a base plate having an upper surface, a pair of spaced apart vertically disposed side panels having bottom edges respectively and being integrally secured respectively along said bottom edges to side edges of said base plate, a resting block interposed between said side panels for supporting the infeed end of said tubular element, at least one open-ended notch formed in an upper edge of each of said side panels, an element extending laterally from said elongated tubular element and being disposed in each of said notches, and an impact receiving element secured atop said elongated tubular element and adapted to receive a percussion force for discharging staples from the outfeed end of said elongated tubular element to said point of use.

2. A stapler according to claim 1 wherein said impact receiving element is disposed approximately midway between said infeed and said outfeed ends of said elongated tubular element.

3. A stapler according to claim 1 wherein said resting block is in abutment with said tubular element and disposed between said side panels thus to cause the staples to be vertically disposed when discharged.

4. A stapler comprising an elongated tubular element having an infeed end and an outfeed end for feeding staples to a point of use, guide means including a base plate having a pair of spaced apart side panels, each said side panel having an upper edge and a bottom edge and being integrally formed with said base plate along said bottom edges, a resting block disposed between the side panels and functioning as a sole support of the tubular member, open-ended notches formed in said upper edge of each of said side panels and screws maintaining alignment of the tubular element, an impact receiving element secured atop said elongated tubular element and adapted to receive a percussion force for driving staples from said outfeed end of said elongated tubular element to said point of use, and said impact receiving element comprising a disc of circular configuration which is securely affixed atop said elongated tubular element and disposed approximately midway between said infeed and said outfeed ends of said elongated tubular element.

* * * * *